US006234134B1

(12) United States Patent
Bedapudi et al.

(10) Patent No.: US 6,234,134 B1
(45) Date of Patent: May 22, 2001

(54) INTERNAL COMBUSTION ENGINE HAVING INTEGRAL ANTI-POLISHING RING

(75) Inventors: Prakash Bedapudi; Jeffrey S. LeBegue, both of Erie, PA (US); Erwin Peter Reichert, Alsdorf (DE)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/596,972

(22) Filed: Jun. 20, 2000

(51) Int. Cl.[7] ..... F02F 3/00
(52) U.S. Cl. ..... 123/193.3
(58) Field of Search ..... 123/193.3, 193.5, 123/193.2

(56) References Cited

U.S. PATENT DOCUMENTS

| | | | | |
|---|---|---|---|---|
| Re. 34,139 | | 12/1992 | Cooper et al. . | |
| 2,202,643 | * | 5/1940 | Berger | 123/193.3 |
| 2,234,780 | * | 3/1941 | Rippingille | 123/193.3 |
| 3,489,130 | | 1/1970 | Polidan et al. . | |
| 3,586,338 | | 6/1971 | Miklau et al. . | |
| 3,620,137 | | 11/1971 | Prasse . | |
| 4,369,980 | | 1/1983 | Backlin . | |
| 4,474,147 | | 10/1984 | Hoopes . | |
| 4,480,844 | | 11/1984 | Kozerski . | |
| 4,620,710 | | 11/1986 | Lambert et al. . | |
| 4,770,134 | | 9/1988 | Foreman et al. . | |
| 5,033,427 | * | 7/1991 | Kawamura et al. | 123/193.3 |
| 5,058,488 | | 10/1991 | Cullen et al. . | |
| 5,112,066 | | 5/1992 | Remmerfelt . | |
| 5,125,375 | * | 6/1992 | Vuk | 123/193.5 |
| 5,341,779 | | 8/1994 | Chen et al. . | |
| 5,343,837 | | 9/1994 | Ward et al. . | |
| 5,553,585 | | 9/1996 | Paro . | |
| 5,603,515 | | 2/1997 | Bock . | |
| 5,692,468 | | 12/1997 | Haman et al. . | |
| 5,878,712 | | 3/1999 | Wolters et al. . | |

* cited by examiner

*Primary Examiner*—Marguerite McMahon
(74) *Attorney, Agent, or Firm*—Carl A. Rowold, Esq.; Holland & Knight LLP; David G. Maire, Esq.

(57) ABSTRACT

An anti-polishing ring (143) formed to be integral with the cylinder head (132) of a diesel locomotive engine (120). A top portion (140) of a piston (128) of the engine is received by a skirt portion (142) of the cylinder head. The skirt portion has a diameter $D_4$ that is greater than the piston diameter $D_3$ but more than the diameter $D_1$ of a cylinder liner (126). A coolant passage (148) may be formed in the cylinder head proximate the integral anti-polishing ring.

15 Claims, 3 Drawing Sheets

INTERNAL COMBUSTION ENGINE HAVING INTEGRAL ANTI-POLISHING RING

BACKGROUND OF THE INVENTION

The present invention relates generally to internal combustion engines, and more particularly to a cylinder head design, and specifically to a diesel locomotive engine built in consideration of the United States Environmental Protection Agency Tier-2 Emissions Standards.

It is well known to use a fuel injected diesel internal combustion engine as a power source for a locomotive. As a piston moves upward within a cylinder of a diesel engine, the air within the cylinder is compressed and heated. Fuel is injected into the combustion chamber as the piston nears its top dead center position. The fuel combusts with the compressed air, thereby providing energy for driving the engine and locomotive. There are many variables affecting the performance of a diesel engine, including the compression ratio, size of intake and exhaust valve openings, timing and duration of fuel injection, geometry of the combustion chamber, and peak temperature of the combustion gasses. In order to promote efficient operation of a diesel engine, it is known to optimize the size of both the intake and exhaust valve openings in order to reduce the pumping loop losses associated with the movement of the combustion and exhaust air. Because the cylinder wall is typically at a lower temperature than the piston top surface, it is also known to avoid the direct impingement of the injected fuel onto the cylinder wall because such fuel will not be completely oxidized during the combustion process. In order the minimize the loss of combustion heat through the cylinder wall and to minimize the amount of fuel that is impinged directly onto the cylinder wall, it is known to form a combustion chamber depression in the top surface of the piston in an area removed from the edges of the piston. One such design is illustrated in U.S. Reissue Pat. No. Re. 34,139 dated Dec. 8, 1992. An alternative design for maintaining the combustion gasses proximate the center of the piston is illustrated in U.S. Pat. No. 5,878,712 issued on Mar. 9, 1999. In this design a domed piston is provided with a dished depression which directs the combustion gasses away from the cylinder walls.

It is also known to utilize an anti-polishing ring in a diesel engine to prevent the formation of deposits such as soot and carbon around the top of the piston during operation of the engine. A small gap exists between the inside diameter of a cylinder and the outside diameter of the top of a piston. This gap defines a volume of relatively stagnant flow extending downward along the circumference of the piston to the level of the first piston ring. Deposits accumulating on the piston surfaces in this gap will reciprocate with the piston, thereby potentially causing wear in the cylinder/liner wall. U.S. Pat. No. 5,553,585 issued on Sep. 10, 1996, teaches an anti-polishing ring attached to the cylinder liner and having a diameter smaller than the remainder of the cylinder bore. The anti-polishing ring serves to remove deposits from the piston and to limit such deposits to a diameter smaller than that of the cylinder liner, thereby eliminating the potential for wear resulting from such deposits. However, the presence of an anti-polishing ring creates locations of increased stress, due to the presence of physical discontinuities and due to the variations in the relative heat transfer rates of the ring and the surrounding structures.

The United States Environmental Protection Agency has issued regulations directed to reducing the emissions from diesel locomotive engines. The Tier-2 Emissions Standards become effective on Jan. 1, 2005, and will require a significant reduction in the production of unburned hydro-carbons by diesel locomotive engines. To minimize the hide-out of unused air in the relatively stagnant volume around the top of the piston, it is desirable to reduce the size of the gap between the piston and the cylinder. However, the smaller the size of this gap, the greater the concern for wear of the cylinder caused by deposits in this area.

BRIEF SUMMARY OF THE INVENTION

Thus there is a particular need for an engine design that has the advantages of an anti-polishing ring, but that does not suffer the increased stress levels associated with prior art anti-polishing ring designs.

Accordingly, an internal combustion engine is described herein having: a cylinder block defining at least one bore; a cylinder liner having an inside first diameter disposed in the bore; a cylinder head sealingly disposed over an end of the cylinder liner; a piston disposed for reciprocating motion in the cylinder liner, the piston comprising a top portion having a second diameter smaller than the first diameter; the cylinder head further comprising an anti-polishing ring formed integral to the cylinder head, the anti-polishing ring having a diameter greater than the second diameter for receiving the top portion of the piston at a top dead center position and less than the first diameter for limiting the diameter of deposits forming on the top portion of the piston.

BRIEF DESCRIPTION OF THE DRAWING

The features and advantages of the present invention will become apparent from the following detailed description of the invention when read with the accompanying drawings in which.

DETAILED DESCRIPTION OF THE INVENTION

Figure 1:
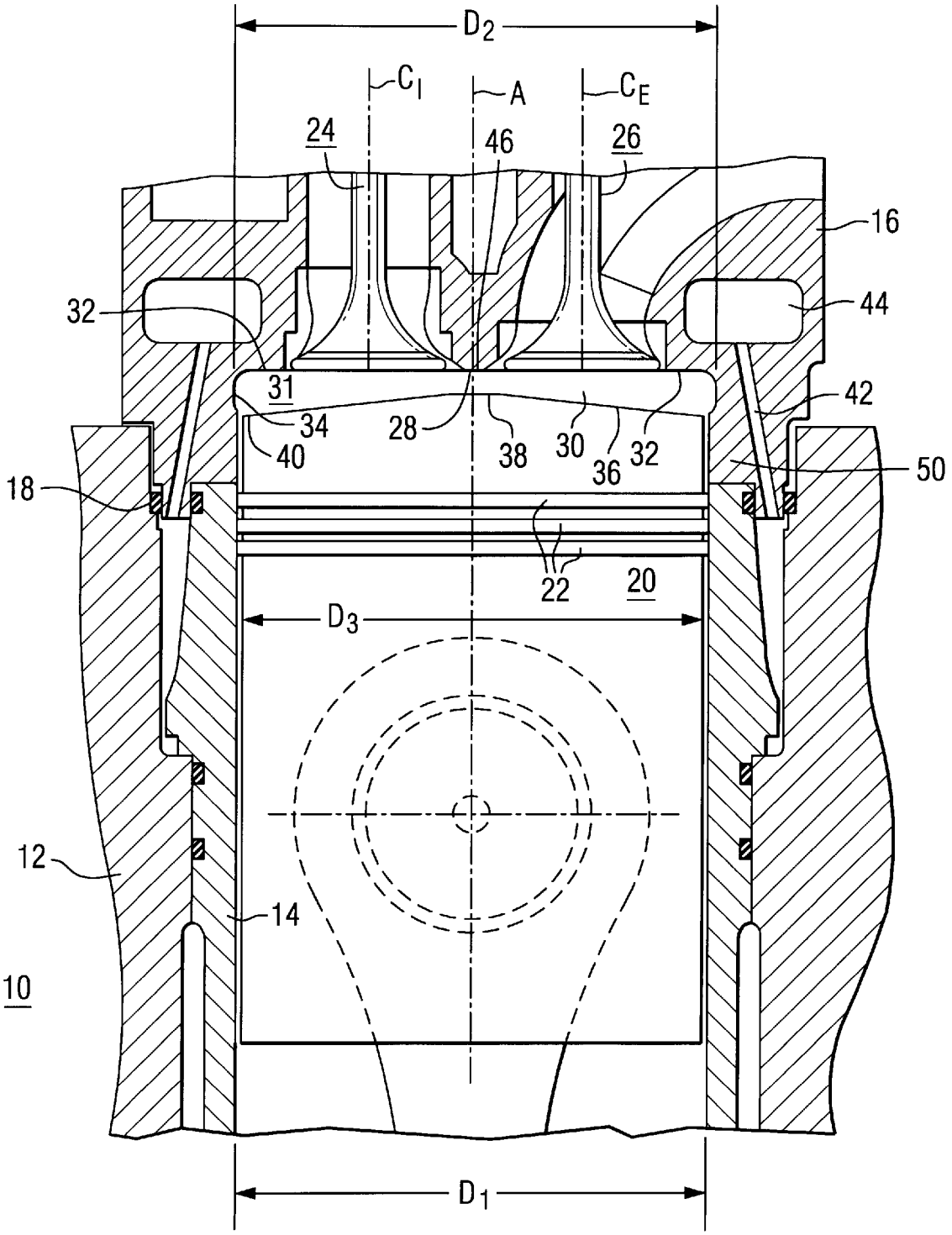
FIG. 1 illustrates one cylinder of a diesel locomotive engine having a combustion chamber formed to be integral with the cylinder head.

FIG. 1 illustrates a portion of an internal combustion engine 10 as may be utilized to power a locomotive. The figure illustrates a cross-sectional view of a single cylinder 12 of the engine 10. As is known in the art, engine 10 may have a plurality of such cylinders, and may be configured in a traditional V-12 design. In the embodiment of FIG. 1, cylinder 12 includes a stainless steel liner 14 formed to have a first diameter $D_1$ about a longitudinal axis A. Other embodiments may not utilize a separate liner. A cylinder head 16 is sealingly connected across a top 18 of the cylinder 12. A piston 20 is disposed for reciprocating motion along axis A within the cylinder 12. The piston 20 is sealed against the cylinder liner 14 by a plurality of rings 22. Intake valves 24 and exhaust valves 26 are disposed in the cylinder head 16 proximate the top 18 of the cylinder 12. A fuel injection nozzle 28 is also disposed in the cylinder head 16 proximate the axis A.

A combustion chamber 30 is formed in the cylinder head 16 proximate the top 18 of cylinder 12. The combustion chamber 30 is defined in part by an open volume 31 formed in the cylinder head 16 to have a second diameter $D_2$ about the axis A that is greater than the first diameter $D_1$. The combustion chamber 30 is formed to have a relatively flat top wall 32 and a generally circular outer diameter wall 34. Intake valve 24 and exhaust valve 26 open into the combustion chamber 30 through the combustion chamber top wall 32. The second diameter $D_2$ may be formed to be 102–120% of the first diameter $D_1$, such as where the diameter of cylinder liner 14 is 25 cm. and the diameter of the combustion chamber 30 may be 25.5–30 cm. Preferably, the second diameter may be 105–111% of the first diameter, and it is believed that a design wherein the second diameter is about 108% of the first diameter would provide a good balance considering stress levels in the cylinder head, compression ratio, and physical layout restrictions. It may be appreciated that by forming combustion chamber 30 to have a diameter greater than the diameter of cylinder 12, the size of the intake and exhaust valves 24,26 may be increased accordingly, since valve diameter is generally limited by the overall cylinder diameter. Whereas in prior art designs, the diameter of the exhaust valve may typically be between 32–35% of the cylinder diameter, in the embodiment illustrated in the figure, the diameter of exhaust valve 26 may be between 35–40% of the first diameter $D_1$. Similarly, the diameter of the intake valve 24 may be at least 35–40% of the first diameter $D_1$. Unlike prior art engines, the center line of the intake valve $C_i$ and the center line of the exhaust valve $C_e$ may be disposed closer to the circumference of the cylinder than to the axis A as viewed along a line perpendicular to the axis A. Thus by spreading the valve center lines apart, additional room is provided along top wall 32 to provide valves that are relatively larger than are the prior art valves for a given cylinder diameter.

Piston 20 is formed to have a top wall 36 that is a convex surface whereby a center portion 38 of the top wall 36 projects closer to the combustion chamber 30 than does an edge portion 40 of the top wall 36. This convex surface forms a generally ring-shaped combustion volume when the piston 20 approaches a top dead center position. One may appreciate that the generally ring-shaped combustion volume will result in a greater heat loss to the cylinder head 16 and cylinder liner 14 than would be experienced in prior art designs wherein the combustion volume is concentrated near the center portion of the piston. This additional heat loss has the effect of lowering the peak combustion temperature in the combustion chamber 30, thereby reducing the production of the oxides of nitrogen during the operation of the engine. This additional heat energy may be removed by forming one or more cooling passages 42 in the cylinder head 16 proximate the outer diameter wall portion 44 of the combustion chamber 30. Coolant such as engine cooling water 44 may be circulated through the cooling passages 42 to remove such heat to the ambient environment.

In order to overcome the inherent reduction in efficiency resulting from the geometry of the combustion volume of the engine 10, the applicants have taken advantage of the additional distance provided between fuel injection nozzle 28 and the outer diameter wall 34. While prior art fuel injection nozzles were designed to direct the injection flow generally downward toward the combustion chamber formed near the center of the piston, the fuel injection nozzle 28 of the present invention is formed to inject fuel in a direction generally along a radius of the generally ring-shaped combustion volume and in a direction generally toward the outer diameter wall portion 34 of the combustion chamber 30. Fuel injection nozzle 28 may include a fuel jet 46 disposed to direct the flow of fuel at an angle of between 80° and 85° from the axis A. Such an angle provides the maximum distance between the fuel jet 26 and the point on the cylinder head 16 towards which the fuel is directed. To most fully take advantage of this increased distance, it is desirable to increase the pressure provided to the fuel injection nozzle 28 over that which is known in the prior art. In one embodiment the fuel is provided to injection nozzle 28 at a pressure of >1600 bar, or alternatively at a pressure of >1700 bar, or alternatively at a pressure of >1800 bar. Such increased pressures enable the fuel to be atomized to have an average particle size of no more than 30–80 microns SMD, or for example 35 microns at peak injection pressure SMD, as it is introduced into the combustion chamber 30. By providing such a fine fuel mist at such a high pressure, the total duration of the fuel injection flow may be reduced when compared to prior art engines. For example, the flow of fuel into combustion chamber 30 may be initiated when the piston 20 reaches a point of between 0–5° before top dead center position, and is terminated no later than the time when the piston 30 reaches a position of 25–30° after top dead center position. Thus, the combination of structures illustrated in the figure provides for a combustion process that is very efficient yet has a reduced peak temperature when compared with prior art designs.

The cylinder 16 may further be formed to include an anti-polishing ring 50 formed to be integral with the cylinder head. Anti-polishing rings are know to have a diameter less than the cylinder but more than the top of the piston so as to prevent the build-up of carbon and soot deposits around the top of the piston. The anti-polishing ring of prior art engines is normally designed as a separate structure that is attached to the cylinder liner. In the embodiment illustrated in FIG. 1, the anti-polishing ring 50 is disposed below the combustion chamber 30 and is formed to have a third diameter $D_3$ less than the second diameter $D_2$. The combustion chamber 30 and integral anti-polishing ring 50 may be formed by the removal of material from a blank cylinder head using known machining processes.

In one embodiment, a diesel locomotive engine may have a 90 mm exhaust diameter, 92 mm intake valve diameter, 250 mm bore diameter, 1800 bar injection pressure, 270 mm chamber diameter, injector angle of 82 degrees with ten injector holes, an injection start at 3 degrees before TDC and injection end no later than 27 degrees after TDC, and a fuel flow rate of 2500 cubic mm per stroke.

Figure 2:
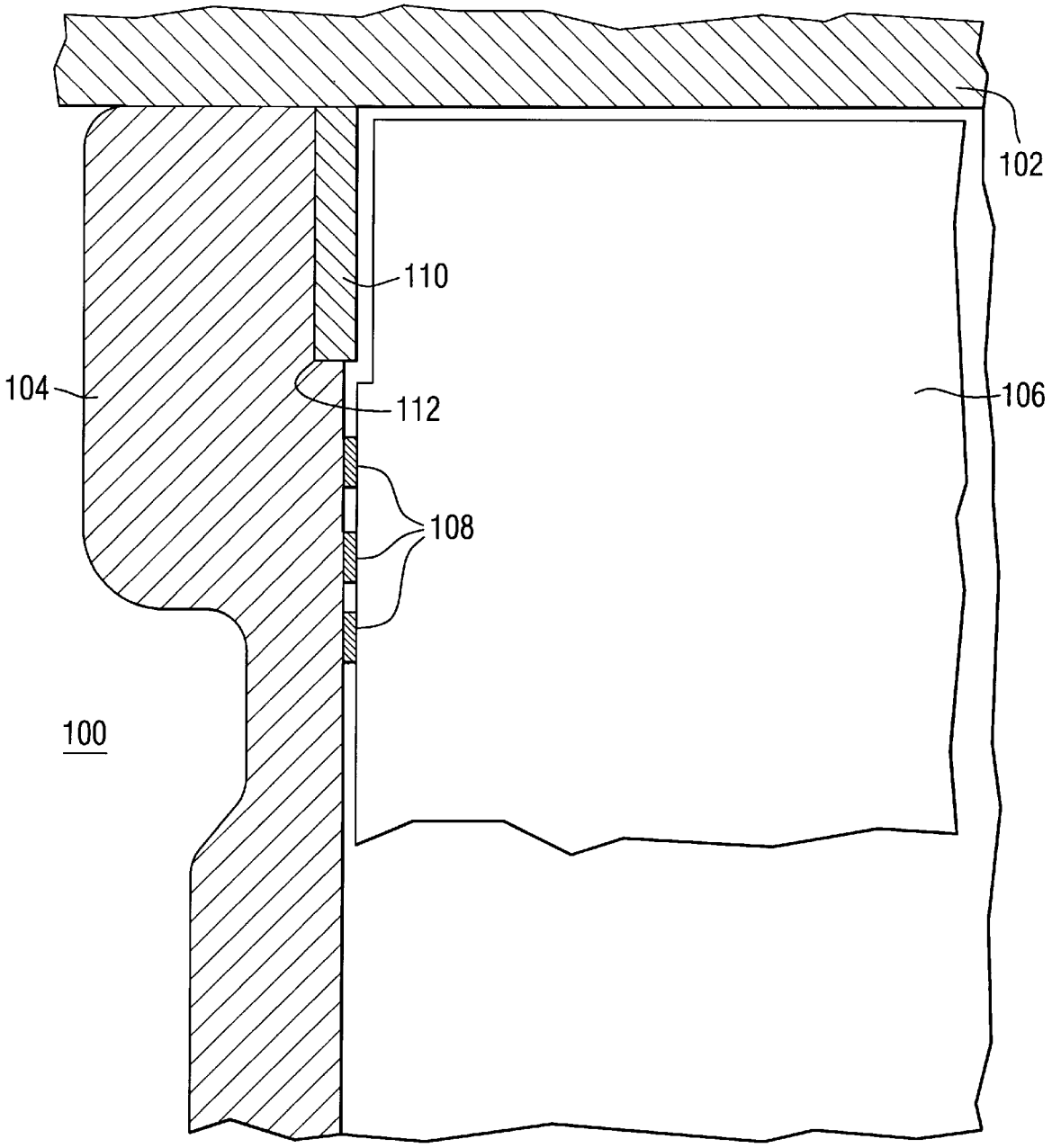
FIG. 2 PRIOR ART
FIG. 2 illustrates a prior art engine having an anti-polishing ring.

FIG. 2 illustrates one cylinder of a prior art engine 100. The engine 100 includes a cylinder head 102, a cylinder liner 104, and a piston 106 having a plurality of rings 108. The engine 100 also includes an anti-polishing ring 110 attached to a cylinder liner 104. As discussed above, the anti-polishing ring 110 is disposed in a notch 112 formed in the cylinder liner 104. The notch 112 creates a stress riser, the effect of which is increased by the temperature gradients caused by the differences in thermal conductivity of the anti-polishing ring 110 and the cylinder liner 104. For large, high compression ratio diesel engines such as used on modem locomotives, the stress levels for such a design are problematically high.

Figure 3:
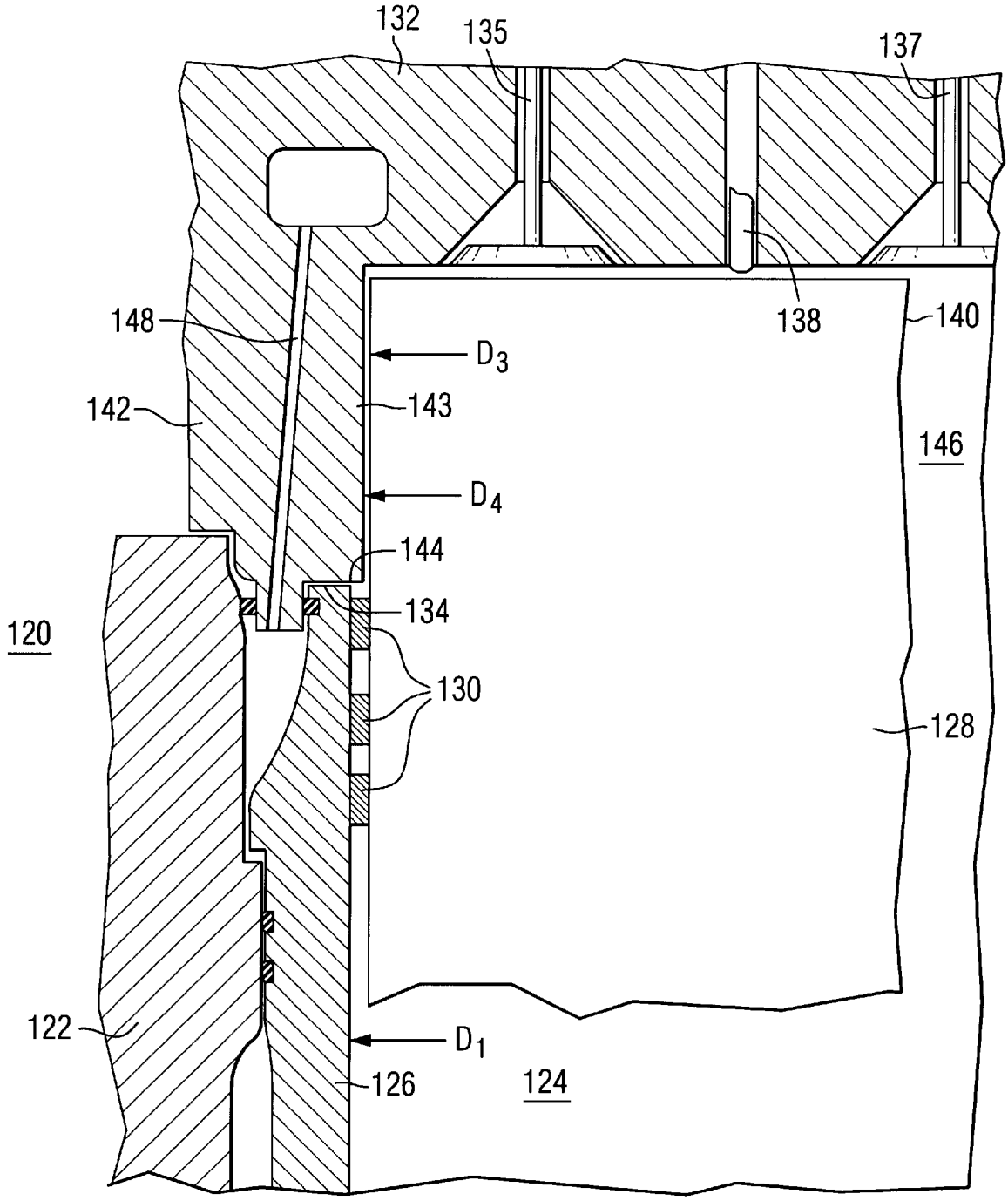
FIG. 3 illustrates a diesel locomotive engine having an anti-polishing ring formed as an integral skirt of the cylinder head.

FIG. 3 illustrates a partial sectional view of another embodiment of a diesel locomotive engine 120, including a cylinder block 122 defining a bore 124, a cylinder liner 126 having an inside diameter $D_1$, a piston 128 having a plurality of rings 130 disposed for reciprocating motion in the cylinder liner 126, and a cylinder head 132 sealingly disposed over an end top surface 134 of cylinder liner 126. One may appreciate that the block 122, bore 124 and liner 126 may be collectively referred to as a cylinder of engine 120. Other embodiments may not utilize a liner 126, but rather may have the inside diameter $D_1$ formed directly into the engine block 122. An intake valve 135, exhaust valve 137 and fuel injection nozzle 138 are disposed in cylinder head 132. An upper portion 140 of piston 128 has a diameter $D_3$ that is less than the cylinder liner diameter $D_1$ to permit the piston 128 to reciprocate therein.

Cylinder head 132 further includes a skirt portion 142 having a bottom surface 144 engaged against the top surface 134 of liner 126, i.e. a top surface of the cylinder. Skirt portion 142 has a generally circular cross section bore 146 having a diameter $D_4$ that is greater than the upper piston diameter $D_3$ but less than the cylinder liner diameter $D_1$ for receiving the top portion 140 of piston 128 when the piston 128 is at or near its top dead center position. Because of the relative diameters of the skirt portion 142, piston 128 and liner 126, skirt portion 142 functions as an anti-polishing ring 143 formed integral to the cylinder head 132. The anti-polishing ring 143 limits the diameter of deposits forming on the top portion 140 of the piston 128 during the operation of engine 120. The integral construction of an anti-polishing ring 143 and the cylinder head 132 eliminates the stress concentrating structures of the prior art anti-polishing rings, thereby making the design of FIG. 3 useful for high compression ratio diesel locomotive engines.

A coolant passage or passages 148 may also be formed through the skirt portion 142 proximate the anti-polishing ring 142 of cylinder head 132 to remove heat, to regulate temperature transients, and to reduce the peak firing temperature of the combustion in engine 120.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim as our invention:

1. An internal combustion engine comprising:

a cylinder block defining at least one bore, a cylinder liner having an inside first diameter disposed in the bore;

a cylinder head sealingly disposed over an end of the cylinder liner;

a piston disposed for reciprocating motion in the cylinder liner, the piston comprising a top portion having a second diameter smaller than the first diameter;

the cylinder head further comprising an anti-polishing ring formed integral to the cylinder head, the anti-polishing ring having a diameter greater than the second diameter for receiving the top portion of the piston at a top dead center position and less than the first diameter for limiting the diameter of deposits forming on the top portion of the piston.

2. The internal combustion engine of claim 1, further comprising a coolant passage formed proximate the anti-polishing ring.

3. The internal combustion engine of claim 1, further comprising a combustion chamber formed in the cylinder head, the combustion chamber being disposed above the anti-polishing ring and having a third diameter greater than the first diameter.

4. The internal combustion engine of claim 3, further comprising a coolant passage formed through the cylinder head proximate the combustion chamber.

5. The internal combustion engine of claim 3, wherein the third diameter is between 102–120% of the first diameter.

6. The internal combustion engine of claim 3, wherein the third diameter is between 105–111% of the first diameter.

7. A diesel engine for a locomotive, the diesel engine comprising:

a cylinder block defining at least one bore, a cylinder liner having an inside first diameter disposed in the bore;

a piston disposed for reciprocating motion in the cylinder liner, the piston comprising a top portion having a second diameter smaller than the first diameter;

a cylinder head in sealing contact with an end of the cylinder liner, the cylinder head further comprising:

an inlet valve, an outlet valve, and a fuel injection nozzle disposed in the cylinder head; and an anti-polishing ring formed integral to the cylinder head, the anti-polishing ring having a diameter greater than the second diameter for receiving the top portion of the piston and less than the first diameter for limiting the diameter of deposits forming on the top portion of the piston.

8. The diesel engine of claim 7, further comprising a cooling passage formed through the cylinder head proximate the anti-polishing ring.

9. The diesel engine of claim 7, further comprising a combustion chamber formed in the cylinder head, the combustion chamber being disposed above the anti-polishing ring and having a third diameter greater than the first diameter.

10. The diesel engine of claim 9, further comprising a coolant passage formed through the cylinder head proximate the combustion chamber.

11. The diesel engine of claim 7, wherein the fuel injection nozzle comprises a fuel jet disposed to direct a flow of fuel at an angle of between 80–85 degrees from the axis of the bore.

12. A cylinder head for an internal combustion engine, the engine having a cylinder liner having a first diameter and a piston having a second diameter disposed for reciprocating motion within the cylinder liner, the cylinder head comprising a skirt portion having a bottom surface for engagement with a top surface of the cylinder liner, the skirt portion defining a bore having a diameter greater than the second diameter and less than the first diameter for receiving a top portion of the piston at a top dead center position.

13. The cylinder head of claim 12, further comprising a coolant passage formed in the skirt portion.

14. The cylinder head of claim 12, further comprising a combustion chamber formed in the cylinder head, the combustion chamber being disposed above the skirt portion and having a third diameter greater than the first diameter.

15. The cylinder head of claim 14, further comprising a coolant passage formed proximate the combustion chamber.

* * * * *